United States Patent [19]

Fishman et al.

[11] Patent Number: 4,660,725

[45] Date of Patent: Apr. 28, 1987

[54] STACKABLE INTEGRALLY MOLDED RECEPTACLE

[75] Inventors: Aaron H. Fishman, Hewlett Harbor, N.Y.; Joseph Bottitta, Belleville, N.J.

[73] Assignee: APL Corporation, Miami Beach, Fla.

[21] Appl. No.: 764,906

[22] Filed: Aug. 12, 1985

[51] Int. Cl.[4] ..... B65D 21/02

[52] U.S. Cl. ..... 206/509; 206/511; 206/815; 220/23.6; 312/111

[58] Field of Search ..... 206/509, 511, 815; 220/23.6, 72; 312/107, 111

[56] References Cited

U.S. PATENT DOCUMENTS

| | | | |
|---|---|---|---|
| 1,699,765 | 1/1929 | Staples | 206/815 |
| 2,634,020 | 4/1953 | Bartholomew | 220/72 |
| 3,028,207 | 4/1962 | Darnell . | |
| 3,030,163 | 4/1962 | Gottsegen | 206/509 |
| 3,257,154 | 6/1966 | Lewis . | |
| 3,974,898 | 8/1976 | Tullis | 312/111 |
| 4,015,713 | 4/1977 | Clipson et al. . | |
| 4,176,747 | 12/1979 | Aho . | |
| 4,401,216 | 8/1983 | Koch | 220/23.6 |
| 4,423,913 | 1/1984 | Lee . | |

FOREIGN PATENT DOCUMENTS

| | | | |
|---|---|---|---|
| 1171332 | 5/1964 | Fed. Rep. of Germany | 206/509 |
| 1049484 | 11/1966 | United Kingdom | 206/511 |
| 1143031 | 2/1969 | United Kingdom | 206/509 |

*Primary Examiner*—George E. Lowrance

*Attorney, Agent, or Firm*—Caesar, Rivise, Bernstein, Cohen & Pokotilow, Ltd.

[57] ABSTRACT

An integrally molded storage receptacle having sidewalls which taper slightly from front to back to facilitate removal of the receptacle from the mold in which it is made. The receptacle also includes pairs of compensating ribs to enable it to be stacked on similarly constructed receptacles while maintaining vertical alignment. The receptacle also includes a transparent pivotable door.

10 Claims, 9 Drawing Figures

FIG. 2
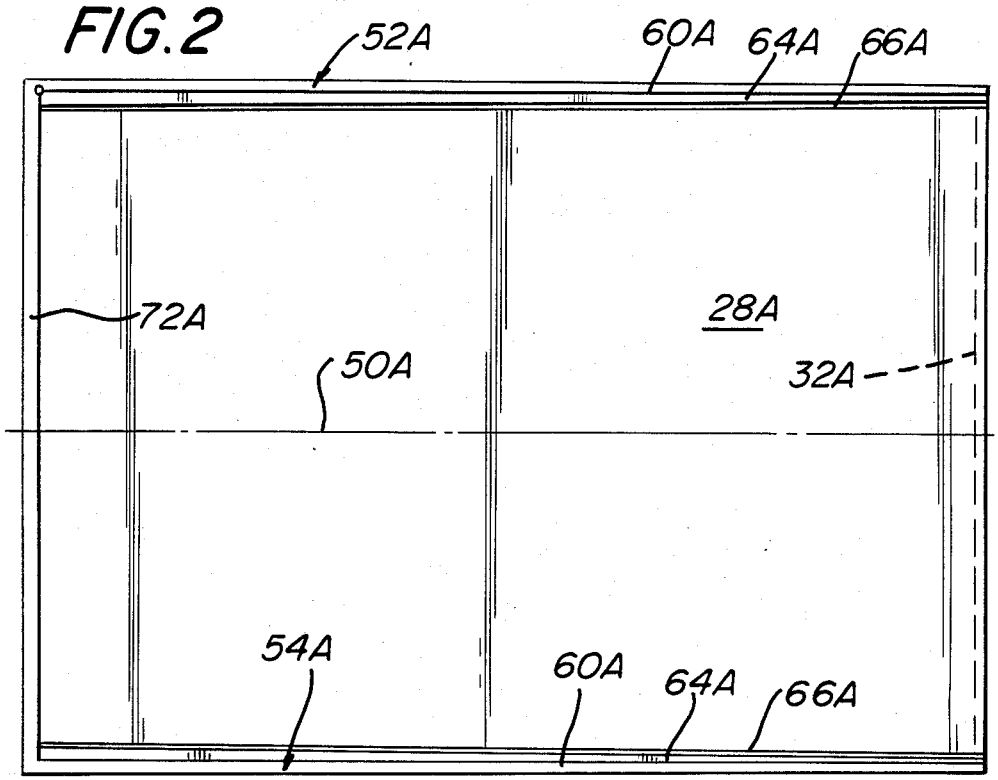
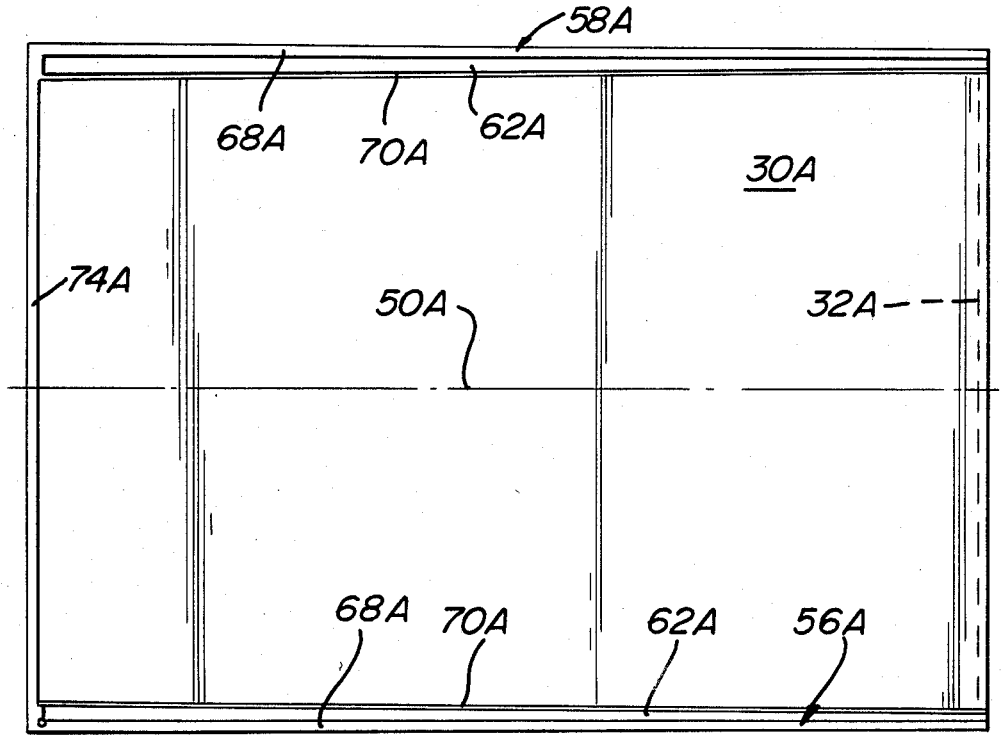
FIG. 3

FIG.4
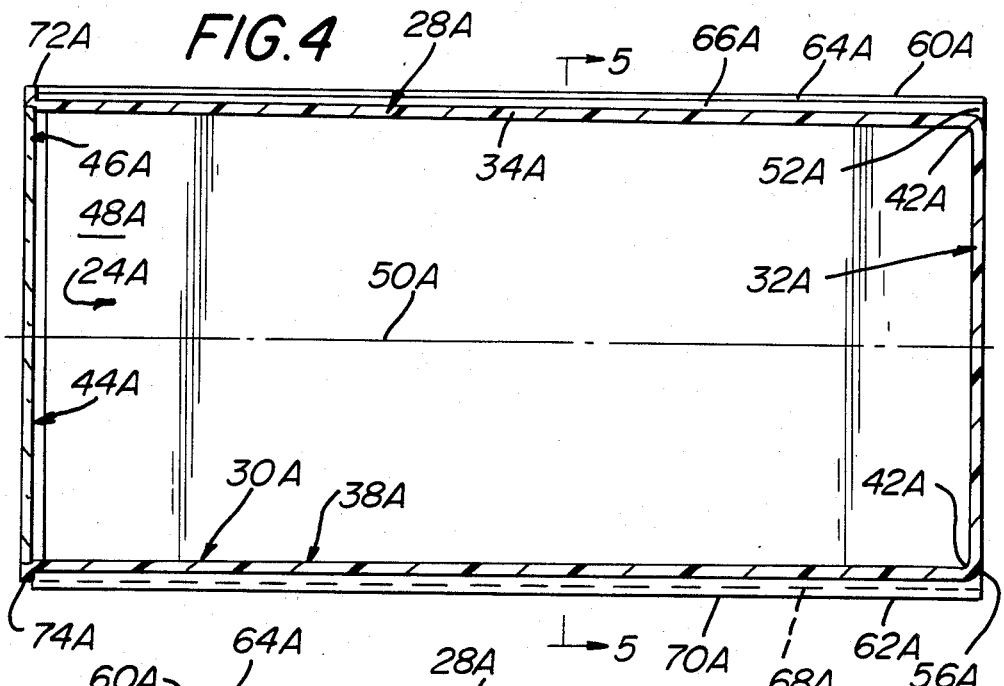
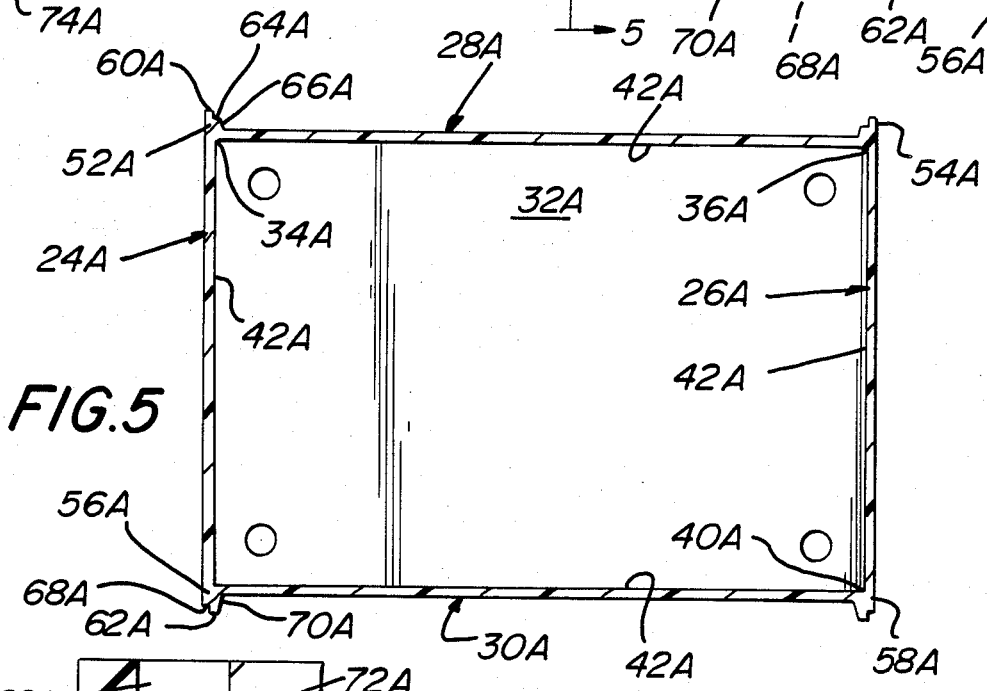
FIG.5
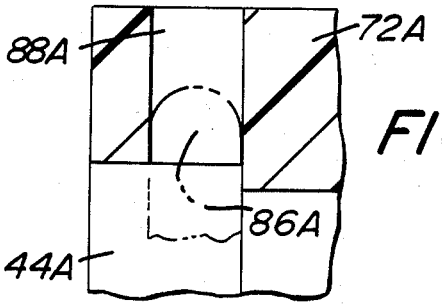
FIG.9

FIG.7
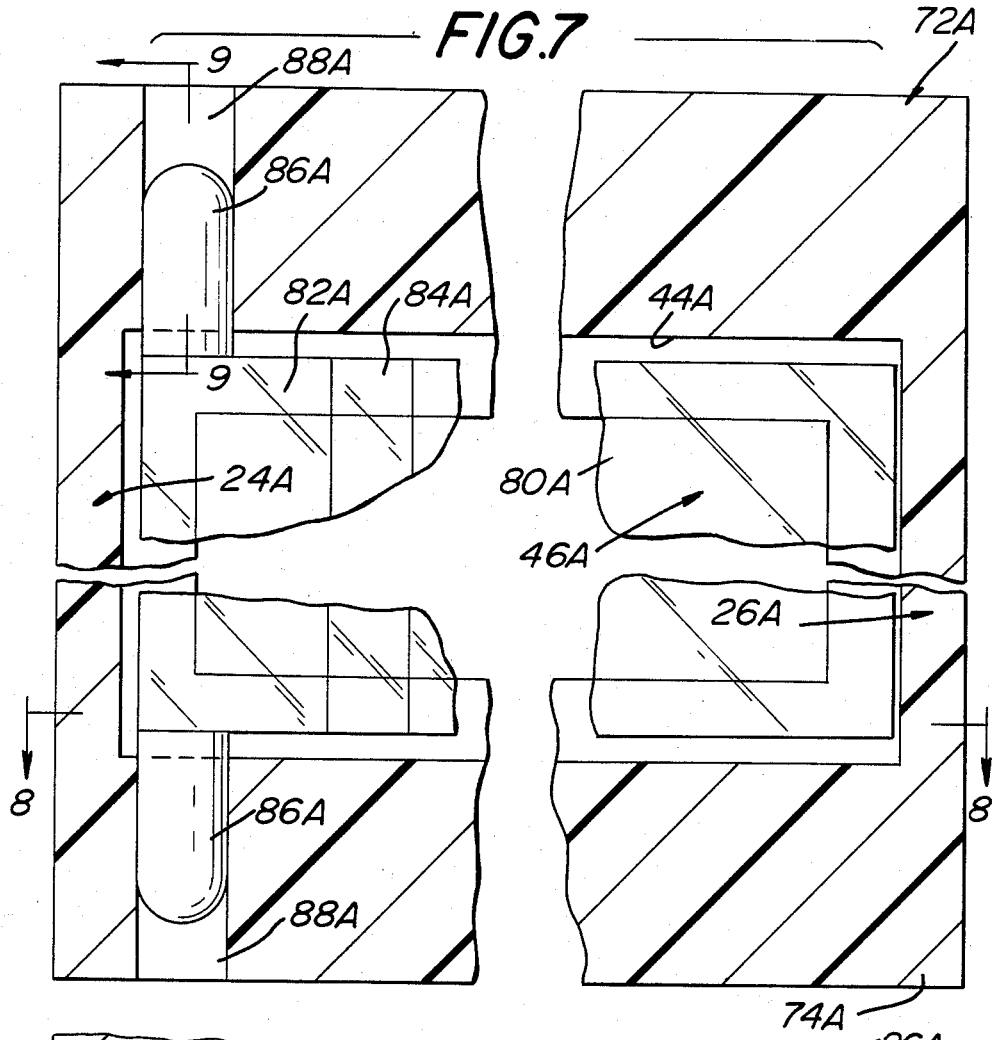
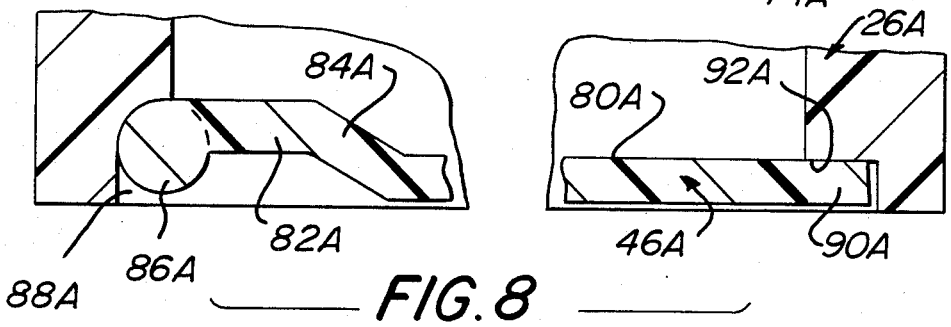
FIG. 8

STACKABLE INTEGRALLY MOLDED RECEPTACLE

BACKGROUND OF THE INVENTION

This invention relates generally to storage devices and, more particularly, to stackable receptacles for the storage of articles, such as wearing apparel, shoes, etc., therein.

Heretofore many receptacles, bins, crates, boxes or the like have been disclosed in the patent literature or are commercially available and which are arranged to be stacked one on top of another to create a multi-compartment storage system. Examples of such devices are shown in U.S. Pat. Nos. 3,028,207 (Darnell), 3,257,154 (Lewis), 4,015,713 (Clipson et al.), 4,176,747 (Aho), and 4,423,913 (Lee).

While prior art storage devices have been generally suitable for their intended purposes, they still leave something to be desired from the standpoint of ease of manufacture, simplicity of construction, cost, and functionality.

OBJECTS OF THE INVENTION

Accordingly, it is the general object of the instant invention to provide a receptacle or container for the storage of articles therein.

It is a further object of the instant invention to provide a storage receptacle which can be readily molded as an integral unit.

It is still a further object of this invention to provide a receptacle having walls constructed to facilitate the molding of the receptacle as a unitary body while having improved means for enabling similar receptacles to be stacked in vertical alignment.

It is yet a further object of this invention to provide a storage receptacle which can be used individually to store an article therein or which can be stacked in vertical alignment on similarly constructed receptacles to form a multi-compartment storage system for plural articles.

It is still a further object of this invention to provide a storage receptacle having an opening which includes a movable door.

SUMMARY OF THE INVENTION

These and other objects of the instant invention are achieved by providing a unitary molded receptacle arranged to be stacked on a second and similarly constructed receptacle. The receptacle comprises a cavity having a longitudinal axis and an opening. The cavity is defined between a pair of side walls, a top wall and a bottom wall. The walls join one another along their marginal edges. Each wall includes a front portion and a rear portion. The opening of the receptacle is located adjacent the front portion of the walls. The height of each of the side walls contiguous with the cavity tapers from the front to the rear thereof at an acute angle to the longitudinal axis so that the cavity portion contiguous with the rear portion of the top and bottom wall is of lesser height than the cavity portion contiguous with the front portion of the top and bottom wall. There is also provided upper and lower pairs of support ribs. Each rib of the upper pair projects upward from the receptacle contiguous with the respective one of the side walls and with a portion of the top wall. In a similar manner each rib of the lower pair projects downward from the receptacle contiguous with the respective one of the side walls and with a portion of the bottom wall. Each of the ribs includes one surface compensating for the tapered side walls, with the compensating surface of each of the ribs being parallel to one another. The compensating surface of each of the lower pairs of ribs of one receptacle are arranged to engage and mate with the compensating surface of each of the upper pair of ribs of the second receptacle to enable the one receptacle to be stacked on the second receptacle in vertically alignment and resistent to lateral displacement.

DESCRIPTION OF THE DRAWINGS

Other objects and many of the attendant advantages of this invention will be readily appreciated when the same becomes better understood by reference to the following detailed description when considered in connection with the accompanying drawing wherein:

FIG. 2 is a top plan view of one of the receptacles shown in FIG. 1;

FIG. 3 is a bottom plan view of said one receptacle;

FIG. 4 is an enlarged sectional view taken along line 4—4 of FIG. 1;

FIG. 5 is a sectional view taken along line 5—5 of FIG. 4;

FIG. 7 is an enlarged sectional view taken along line 7—7 of FIG. 1;

FIG. 8 is a sectional view taken along line 8—8 of FIG. 7; and

FIG. 9 is an enlarged view partially in section of a corner of the receptacle shown in FIG. 1.

DETAILED DESCRIPTION OF THE PREFERRED EMBODIMENT

Figure 1:
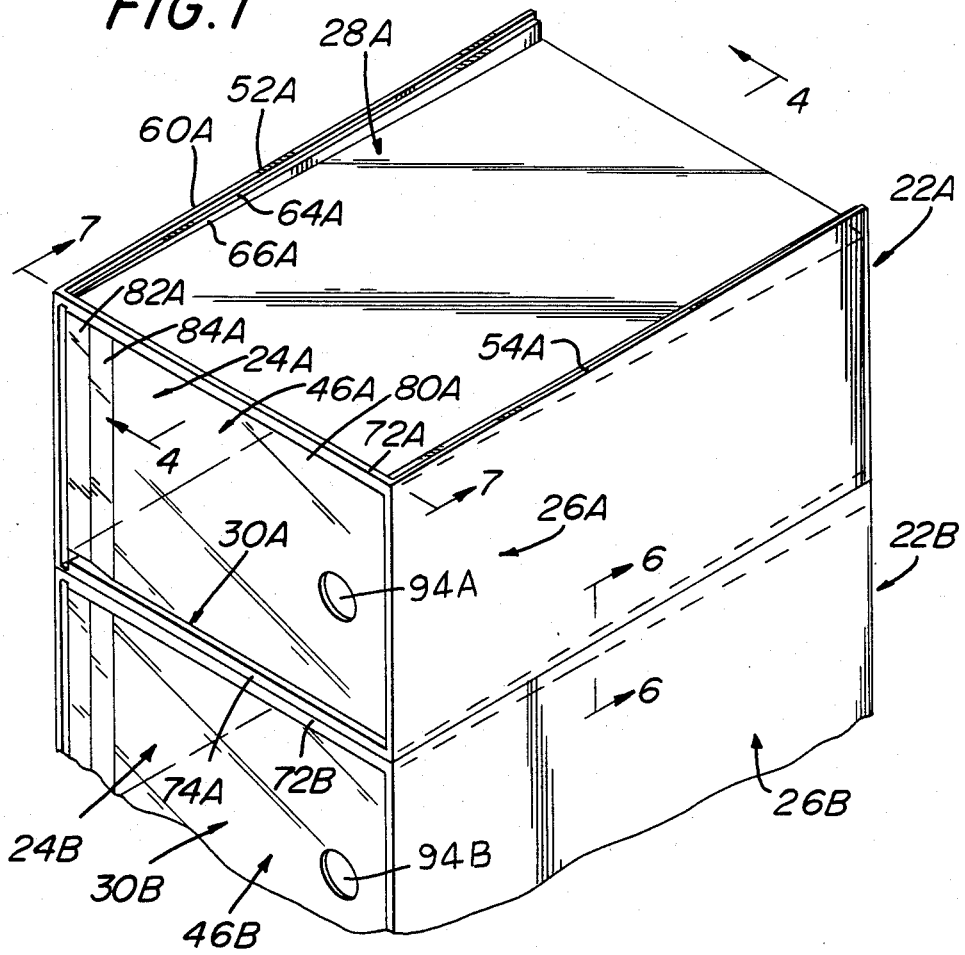
FIG. 1 is a perspective view of a pair of receptacles constructed in accordance with the subject invention and stacked upon each other.

Referring now in greater detail to the various figures of the drawing wherein like reference characters refer to like parts, there is shown generally at 20 a multi-compartment storage system composed of two stackable receptacles 22A and 22B, constructed in accordance with the instant invention. Each of the receptacles is of identical construction and therefore all of the corresponding parts of each of the two receptacles will be given the same reference number except for the suffix "A" or "B" to indicate the receptacle to which that component belongs.

Referring now to FIGS. 1, 4 and 5, the details of the uppermost receptacle 20A will be described. As can be seen therein the receptacle 20A is a generally rectangular body comprised of a pair of side walls 24A and 26A, a top wall 28A, a bottom wall 30A and a rear wall 32A. The side walls, top wall, bottom wall and rear wall are all molded as an integral unit. As seen clearly in FIG. 5 the top marginal edge of the side wall 24A joins the contiguous side marginal edge of the top wall 28A along the linear joint line 34A. A similar linear joint line exists between the top marginal edge of side wall 26A and the other side marginal edge of top wall 28A. This second joint line is denoted by the reference numeral 36A. The lower marginal edge of side wall 24A is joined to the contiguous side edge of bottom wall 30A along joint line 38A. In a similar manner the bottom edge of the side wall 26A joins the other side edge of bottom wall 30A at a linear joint line 40A. The peripheral edges of the back wall 32A are joined to the rear edges of the top wall 28A, side wall 24A, bottom wall 30A and side wall 26A along linear joint lines 42A (FIG. 4).

As can be seen in FIGS. 1 and 4 the front of receptacle 22A is open at 44A. Mounted within the opening 44A is a pivotable door 46A. The details of the door will be described later. Suffice for now to state that the door 46A is arranged to be mounted generally flush with the front of the receptacle and without pivoting therein, while enabling it to be readily pivoted outward to provide access to the interior of the receptacle.

As can be seen each of the side walls, top wall and bottom wall as well as the back wall is a generally planar member of substantially rectangular shape although the sidewalls are tapered slightly in a front-to-back taper as will be described later. This taper or draft is provided to facilitate the removal of the receptacle from the mold in which it is formed. Thus, as can be seen clearly in FIG. 4 the height of the interior or chamber 48A of the receptacle and adjacent the front opening 44A is of a slightly greater dimension than the height of the chamber adjacent the rear wall 32A. In short the height of the side wall 24A between the joint lines 34A and 38A is greater adjacent the mouth 44A than adjacent the rear wall 32A. In a similar manner the height of the side wall 26A, that is the space between the joint lines 36A and 40A, is greater at the front of the receptacle than the rear of the receptacle. In a similar manner the top wall and bottom wall each taper from front to rear. In particular the width of the top wall 28A, that is the spacing between the joint lines 34A and 36A adjacent the front end of the receptacle is greater than the spacing between those joint lines at the rear wall. The bottom wall 30A is similarly dimensioned as the top wall 28A.

In accordance with the preferred embodiment of the invention the degree of taper of each of the walls with respect to a longitudinal axis 50A (FIG. 4) of the receptacle is a very small acute angle, e.g., $\frac{1}{2}°$ to $\frac{1}{4}°$. This angle insures that a sufficient draft is created to enable the molded receptacle to be readily removed from the mold, while being sufficiently small so as to enable the receptacle to have a generally rectangular appearance.

By virtue of the fact that the top wall and bottom wall are not parallel to each other but in fact extend at an angle to each other, means are provided to ensure that when the receptacle 22A is disposed on receptacle 22B the receptacles are in substantially vertical alignment with each other (parallel to the surface on which the receptacles are disposed) and with their mouths 44A and 44B lying in a common plane or in parallel planes and not at an angle to each other. To that end each receptacle includes two pairs of compensating ribs extending along the marginal edges of the sidewalls contiguous with the joint lines 34A, 36A, 38A and 40A. In particular, as can be seen clearly in FIGS. 1–5, a pair of ribs 52A and 54A project upward from the top surface of the top wall 28A and extend along the joint lines 34A and 36A, respectively. In a similar manner a pair of ribs 56A and 58A project downward from the outer surface of the bottom 30A. In the interests of ease of understanding of the invention the degree of draft of the walls and corresponding degree of inclination of the ribs 52A and 54A is shown by the exaggerated broken lines in FIG. 1 since as noted earlier the draft angle is in actuality very small.

The ribs 52A and 54A forming the upper pair are each constructed identically. Thus, the same reference numerals will be given to the corresponding parts of the two ribs 52A and 54A. As can be seen in FIGS. 1, 4 and 5 each upper rib has an outer planar top surfaces 60A. The height of the rib increases from the front of the receptacle to the rear at the same acute angle to the longitudinal axis 50A that the top wall tapers, thereby compensating for that taper. The pair of lower ribs 56A and 58A are each constructed identically to each other so that their component features are also given the same reference numerals. Accordingly, as can be seen in FIGS. 1, 4 and 5 each of the lower ribs has an outer most planar top bottom surface 62A. The height of each lower rib increases from the front of the receptacle to the rear at the same angle to the longitudinal axis 50A that the bottom wall 30A tapers, thereby compensating for that taper. As should thus be appreciated that the top surfaces 60A of both of the upper ribs 52A and 54A lie in the same plane and parallel to the outermost surfaces 62A of the bottom ribs 56A and 58A, and which outermost surfaces 62A are also coplanar.

As can also be seen in FIGS. 1, 4 and 5, each of the ribs includes an intermediate surface or land. To that end the upper ribs 52A and 54A include land 64A. Land 64A is a planar surface that extends parallel to outermost surface 60A. Like surface 60A the land 64A extends the full length of the rib and is formed as a ledge thereof. As can be seen clearly in FIG. 5' the outer surface of the rib 60A is co-planar with the outer surface of the side wall 24A while the outer surface of rib 54A is co-planar with the outer surface of the side wall 26A. The inner surface of rib 54A is denoted by the reference numeral 66A and, as can be seen in FIG. 5 extends downward at an acute angle, e.g., 15°, to the land 64A.

Like the upper ribs 52A and 54A, the lower ribs 56A and 58A each include an intermediate surface or land. That land is denoted by the reference numeral 68A and extends the full length of the rib 56A parallel to the outermost surface 64A. However land 68A is disposed contiguous with the surface of the rib 56A co-planar with the outer surface of side wall 24A. Thus, the land 68A is an outwardly located land whereas the land 64A of rib 52A in an inwardly directed land. The inner surface of each of the ribs 56A and 58A extends at an acute angle, e.g., 15°, to the rib.

Figure 6:
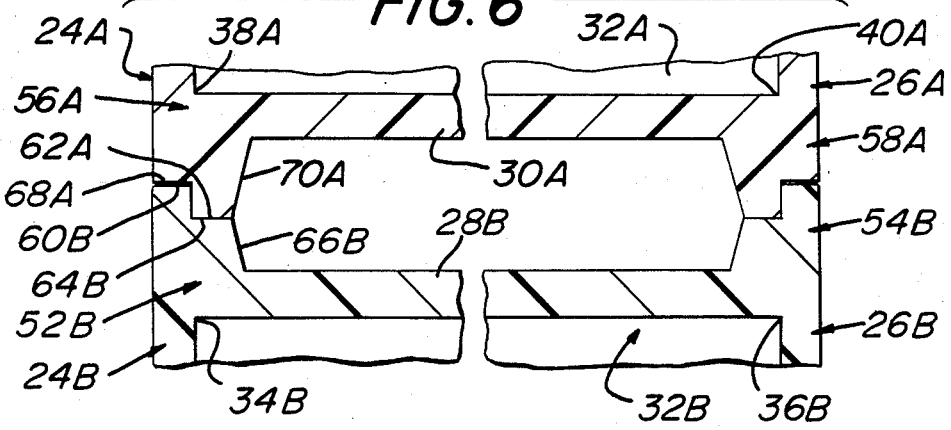
FIG. 6 is an enlarged sectional view taken along line 6—6 of FIG. 1.

As will be appreciated from the foregoing the rib pairs 52A, 54A, 56A, and 58A of respective receptacles 22A and 22B are arranged to engage and mate with one another so as to facilitate the stacking of receptacle 22A on top of receptacle 22B in vertical alignment. To that end as can be seen clearly in FIG. 6 when receptacle 22A is stacked on top of receptacle 22B the land portion 68A of lower rib 56A is disposed on outermost surface 60B of rib 52B whereas the outermost surface 62A of rib 56A is disposed on the land 64B of rib 52B. The compensating surfaces 68A, 60B, 62A and 64B of ribs 58A and 54A, respectively, also cooperate in the same manner as described with reference to ribs 56A and 52B. Moreover, as will be appreciated the outer surfaces 62B of each of the lower ribs 56B and 58B of receptacle 22B will serve as the base for that receptacle on a horizontal surface, such as a shelf (not shown). When so disposed the two receptacles 22A and 22B will be in vertical alignment with their compensating surfaces parallel to that shelf notwithstanding that their top walls and bottom walls will each extend at a slight acute angle thereto.

As can be seen clearly in FIGS. 2 and 3 the outer surface 60A and the intermediate land surface 64A of each of the ribs 52A and 54A taper in width from the front of the receptacle to the rear. The degree of taper is at a slight acute angle, e.g., $\frac{1}{4}°$ to $\frac{1}{2}°$ in the interest of removal of the integrally molded receptacle from its mold. Similarly the outer surface 62A and the intermediate land surface 68A of the lower ribs 56A and 58A also taper from the front of the receptacle toward the rear at the same acute angle and for the same reasons as given above.

The front edge of the top wall 28A is in the form of an upwardly projecting flange 72A (FIGS. 1 and 4). The height of the flange, that is the amount that it projects above the top surface of top wall 28A, is the same as the height of the top surface of each of the ribs 52A and 54A. The bottom wall 30A also includes a flange 74A extending across the full width thereof at the front of the receptacle. The height of flange 74A is the same as the height of land 68A of each of the lower ribs 56A and 58A to enable the receptacles to be stacked without interference. The flanges 72A and 74A serve as means for mounting the door in the front of the receptacle, as will be described later.

Referring now to FIGS. 1, 7 and 8 the details of the door and the mounting means therefore will now be described. As can be seen therein the door 46A is a generally planar member of rectangular profile and is configured to fit within the bounds of the opening 44A in the front of the receptacle 20A. By "generally planar" it is meant that the door includes a planar major section 80A, making up the vast portion of the door, an offset section 82A and a sloped intermediate section 84A. The offset section makes up only a small portion of the door, namely the left marginal edge, as shown clearly in FIG. 8, and lies in a plane slightly offset from the plane from the major section 80A. The amount of offset between the planes is approximately equal to the thickness of the door. The intermediate section is also only a small portion of the door and serves to join the major section 80A and the offset section 82A.

Projecting from the top and bottom edges of the door at the side edge of the offset section 82A are respective pins 86A. Each pin is a cylindrical member having a domed free end. The upper pin 86A is adapted to be snap-fit within a cylindrical aperture 88 in the upper flange 72A. In a similar manner the lower pin is adapted to be snap-fit within an associated aperture 88 in the lower flange 74A. Thus, the door 46A is enabled to pivot outward about the vertical axis connecting the apertures 88A to provide access to the interior of the receptacle.

As can be seen clearly in FIG. 8 the rightmost edge 90A of the door 46A is arranged to abut a recessed ledge 92A in the sidewall 26A of the receptacle. This sidewall thus acts as a stop to prevent the door from swinging into the interior of the receptacle. A fingerhole 94A is provided in the door section 80A to facilitate the opening and closing of the door.

As noted earlier the receptacle itself is formed as an integral unit by molding. The material forming the receptacle can be any suitable moldable material, such as plastic. The door 46A is also formed as an integral unit of plastic, and is preferably transparent to enable viewing of the contents of the receptacle through the door when it is closed.

As will be appreciated from the foregoing the drafted walls of the receptacle of this invention enables it to be readily molded as an integral unit. The compensating ribs make up for the tapered walls to enable plural receptacles to be stacked on top of each other, yet in vertical alignment. By virture of the stackable nature of the subject receptacles such can be used to construct a multi-compartment storage system for holding various articles such as sweaters, stockings, shoes, etc., therein. To that end the size and shape of the receptacles can be configured as desired providing that the draft (tapered nature) of the walls is compensated by corresponding inclined ribs to enable the receptacles when stacked on top of one another to be disposed parallel to the horizontal surface on which the receptacles are disposed and also aligned vertically. While the receptacle is preferable used in combination (e.g., stacked) with similarly constructed receptacles, it can, of course, be used individually, if desired.

Without further elaboration, the foregoing will so fully illustrate my invention that others may, by applying current or future knowledge, readily adopt the same for use under various conditions of service.

I claim:

1. A unitary, molded receptacle arranged to be stacked on a second and similarly constructed receptacle, said receptacle comprising a cavity having a longitudinal axis and an opening, said cavity being defined between a pair of vertical side walls, a top wall and a bottom wall, said walls being joined at their marginal edges, each of said walls having a front portion and a rear portion, said receptacle opening being located adjacent said front portion of said side walls, the height of said side walls contiguous with said cavity tapering from front to rear at an acute angle to said axis so that the cavity portion contiguous with the rear portion of said top and bottom walls is of lesser height than the cavity portion contiguous with the front portion of the top and bottom walls, and upper and lower pairs of support ribs, each rib of said upper pair projecting up from said receptacle contiguous with a respective on of said and with a portion of said top wall, each rib of said lower pair projecting down from said receptacle contiguous with a respective one of said side walls and with a portion of said bottom wall, each of said ribs including at least one surface compensating for said tapered side walls, with the compensating surface of each of said ribs being parallel to one another, the compensating surface of each of the lower pair of ribs of said receptacle being arranged to engage and mate with the compensating surface of each of the upper pair of ribs of said second receptacle, thereby enabling said receptacle to be stacked on said second receptacle so that the sidewalls of said first and second receptacle are in vertical alignment and said first and second receptacles being resistant to lateral displacement therebetween.

2. The receptacle of claim 1 additionally comprising a back wall joining the rear portions of said side walls and said top and bottom walls.

3. The receptacle of claim 2 additionally comprising a door mounted in said opening.

4. The receptacle of claim 3 wherein said door is arranged to pivot with respect to said receptacle to provide access to said cavity.

5. The receptacle of claim 4 wherein said door receptacle includes stop means to prevent said door from pivoting into the interior of said receptacle.

6. The unitary, molded receptacle of claim 1 wherein said receptacle is moulded of a plastic material.

7. The receptacle of claim 5 wherein said door is transparent.

8. The receptacle of claim 7 wherein said door includes an opening therein to facilitate the pivoting of said door means.

9. The receptacle of claim 1 wherein said receptacle is molded of a plastic material.

10. The receptacle of claim 9 additionally comprising a transparent door pivotably mounted within said opening.

* * * * *